US009103518B2

(12) United States Patent
Owada

(10) Patent No.: US 9,103,518 B2
(45) Date of Patent: Aug. 11, 2015

(54) VEHICLE HEADLIGHT

(71) Applicant: Stanley Electric Co., Ltd., Tokyo (JP)

(72) Inventor: Ryotaro Owada, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 238 days.

(21) Appl. No.: 13/850,270

(22) Filed: Mar. 25, 2013

(65) Prior Publication Data

US 2013/0250599 A1 Sep. 26, 2013

(30) Foreign Application Priority Data

Mar. 23, 2012 (JP) ..... 2012-068038

(51) Int. Cl.
*F21V 5/00* (2015.01)
*F21S 8/10* (2006.01)

(52) U.S. Cl.
CPC ..... *F21S 48/125* (2013.01); *F21S 48/1109* (2013.01); *F21S 48/1154* (2013.01); *F21S 48/1163* (2013.01); *F21S 48/1258* (2013.01)

(58) Field of Classification Search
CPC ..... F21S 48/10; F21S 48/125; F21S 48/1258; F21S 48/1266; F21S 48/1275; F21S 48/1283
USPC ..... 362/521, 326, 800, 335, 311.02, 311.1, 362/311.06, 336, 334, 333, 332, 311.09
See application file for complete search history.

(56) References Cited

U.S. PATENT DOCUMENTS

| | | | | |
|---|---|---|---|---|
| 8,100,569 | B2 | 1/2012 | Owada | |
| 8,251,560 | B2 | 8/2012 | Ohno et al. | |
| 8,366,305 | B2 | 2/2013 | Saito | |
| 2005/0162857 | A1* | 7/2005 | Tsukamoto | 362/509 |
| 2005/0207162 | A1* | 9/2005 | Komatsu | 362/296 |
| 2007/0127253 | A1* | 6/2007 | Kawashima et al. | 362/509 |
| 2008/0101063 | A1* | 5/2008 | Koike et al. | 362/231 |
| 2009/0067186 | A1* | 3/2009 | Futami | 362/516 |
| 2010/0110695 | A1* | 5/2010 | Nakamura | 362/311.09 |
| 2011/0096561 | A1* | 4/2011 | Owada | 362/521 |
| 2012/0235169 | A1 | 9/2012 | Seko | |
| 2012/0320617 | A1 | 12/2012 | Ohno et al. | |
| 2013/0058114 | A1* | 3/2013 | Reiners | 362/510 |

FOREIGN PATENT DOCUMENTS

JP 2010-277818 A 12/2010

* cited by examiner

*Primary Examiner* — Thomas A Hollweg
*Assistant Examiner* — Kevin Quarterman
(74) *Attorney, Agent, or Firm* — Kenealy Vaidya LLP

(57) ABSTRACT

A vehicle headlight of a small projector type can provide a favorable light distribution for an overhead sign area along with a light distribution used as a low beam. The headlight can include a semiconductor light source and a projector lens including first, second and third light-emitting surfaces. The headlight can project light having high brightness underneath a horizontal cut-off line while projecting other light in the downward direction using the first and third light-emitting surfaces. Additionally, the headlight can be configured to illuminate light having small chromatic aberration toward the overhead sign area using the second light-emitting surface located between the first and third light-emitting surfaces. Thus, the headlight can provide a favorable light distribution pattern used as a low beam and a favorable light distribution pattern for the overhead sign area using the light that color separation is inhibited so as to conform to a vehicular standard.

20 Claims, 7 Drawing Sheets

VEHICLE HEADLIGHT

This application claims the priority benefit under 35 U.S.C. §119 of Japanese Patent Application No. 2012-068038 filed on Mar. 23, 2012, which is hereby incorporated in its entirety by reference.

BACKGROUND

1. Field

The presently disclosed subject matter relates to vehicle headlights using a semiconductor light source, and more particularly to vehicle headlights with a simple structure that can provide a favorable light distribution pattern to illuminate an overhead sign area in addition to a light distribution pattern used as a low beam for a headlight by using the semiconductor light source.

2. Description of the Related Art

Recently, vehicle headlights using an LED light source, which may provide a light distribution pattern to illuminate an overhead sign area where traffic signs, road signs and the like are located, have been developed. A conventional vehicle headlight shown in FIG. 7*a*, which is a cross-sectional view showing a vehicle lamp capable of forming a light distribution pattern toward the overhead sign area, is disclosed in Patent document No. 1 (Japanese Patent Application Laid Open JP2010-277818).

The vehicle lamp 200 includes an LED light source 210, a projector lens 220 located in a direction toward a light-emission of the LED light source 210, and a reflector 230 located in an upward direction of the LED light source 210 and the projector lens 220, reflecting the emitted from the LED light source 210 in a forward and obliquely upward direction of the LED light source 210 and thereby forming a light distribution pattern for an overhead sign area.

FIG. 7*b* is an exemplary light distribution pattern formed by the vehicle lamp 200, wherein H-H shows a horizontal line and V-V shows a vertical line in a direction toward a light-emission of the vehicle lamp 200. The exemplary light distribution pattern may include a basic light distribution pattern Pa, which is located under the horizontal line H-H so as to extend in the horizontal direction with reference to the vertical line V-V. Accordingly, the basic light distribution pattern Pa may be used as a low beam for a headlight.

In addition, the light distribution pattern projected by the vehicle lamp 200 may include a light distribution pattern Pb, which is formed using the light reflected in the forward and obliquely upward direction of the LED light source 210 by the reflector 230. The light distribution pattern Pb may be directed toward the overhead sign area, and therefore may be used as a light distribution for the overhead sign area.

As described above, the vehicle lamp 200 may provide the basic light distribution pattern Pa and the light distribution pattern Pb, which may illuminate toward the overhead sign area using the above-described structure including an additional reflector. However, such a structure must include the additional reflector 230 for the light distribution pattern Pb, and therefore may always cause problems such that headlights based upon the structure may increase in size and area, and also may be subject to complex structure due to additional parts.

The above-referenced Patent Documents and additional Patent Documents are listed below and are hereby incorporated with their English abstracts and specification in their entireties.

1. Patent document No. 1: Japanese Patent Application Laid Open JP2010-277818

2. Patent document No. 2: U.S. patent application Ser. No. 13/229,663 published as U.S. Patent Publication No. US2012/0235169A1
3. Patent document No. 3: U.S. patent application Ser. No. 12/874,361 published as U.S. Patent Publication No. US 2011-0051446 A1
4. Patent document No. 4: U.S. patent application Ser. No. 12/876,073 published as U.S. Patent Publication No. US 2011-0051448 A1
5. Patent document No. 5: U.S. Divisional patent application (Parent U.S. patent application Ser. No. 12/720,819, U.S. Pat. No. 8,251,560)
6. Patent Document No. 6: U.S. Patent Publication No. 2012-0320617 A1

The disclosed subject matter has been devised to consider the above and other problems, characteristics and features. Thus, an embodiment of the disclosed subject matter can include a vehicle headlight using a semiconductor light source with a simple structure that can form a basic light distribution pattern used as a low beam and a light distribution pattern for an overhead sign area without a reflector. In this case, the vehicle headlight can be constructed from a single projector type headlight that can be formed in a small size, and also can provide a favorable light distribution pattern for the overhead sign area, which can inhibit the color separation and can provide a high level of visibility to drivers and pedestrians. Thus, the vehicle headlight can result in an increase in the possible range of headlight design, and therefore can be employed for various vehicles including a small size car.

SUMMARY

The presently disclosed subject matter has been devised in view of the above and other characteristics, desires, and problems in the conventional art. An aspect of the disclosed subject matter can include providing a small projector type headlight using a semiconductor light source that can provide a favorable basic light distribution pattern used as a low beam and a favorable light distribution pattern for an overhead sign area, which can inhibit the color separation so as to be able to conform to a vehicular standard for a light distribution of the overhead sign area with confidence. Another aspect of the disclosed subject matter can include providing vehicle headlights including at least one LED optical unit, which can form an elbow line between two horizontal cut-off lines such that can be used as a low beam for various vehicles including a small size car.

According to an aspect of the disclosed subject matter, a vehicle headlight can include a semiconductor light source emitting light having a substantially white color tone from an emitting surface, the emitting surface formed in a substantially plane shape and intersecting with an optical axis thereof at a center located on the emitting surface at a substantially right angle; and a projector lens having a horizontal imaginary plane being located adjacent the semiconductor light source so that an optical axis thereof substantially corresponds to the optical axis of the semiconductor light source, a light incoming surface thereof formed in at least one of a plane shape and a concave shape and facing the emitting surface of the semiconductor light source, an light-emitting surface thereof having a polarization angle formed in a convex shape and including a first light-emitting surface, a second light-emitting surface, a third light-emitting surface, a first boundary line located between the second light-emitting surface and the third light-emitting surface and a second boundary line located between the first light-emitting surface and the second light-emitting surface, the horizontal imaginary plane intersecting with the optical axes thereof, the light incoming surface receiving the light from the semiconductor light source during operation, and wherein each of the first light-emitting surface and the third light-emitting surface is configured to diffuse the light in a horizontal direction and in a downward direction with reference to the horizontal imaginary plane, and the second light-emitting surface is configured to diffuse the light in the horizontal direction, wherein light emitted from the second light-emitting surface is configured to intersect with light emitted from the first light-emitting surface in a direction perpendicular to the horizontal imaginary plane.

In the above-described exemplary vehicle headlights, each of the first light-emitting surface and the third light-emitting surface can be configured to gradually increase the polarization angle of the light-emitting surface in the direction perpendicular to the horizontal imaginary plane with increasing distance from the optical axis of the projector lens so as to diffuse the light in a horizontal direction and in a downward direction with reference to the horizontal imaginary plane, and also when the emitting surface of the semiconductor light source is divided into two surfaces by the horizontal imaginary plane, each of the two surfaces can be formed in a substantially rectangular shape. The first boundary line of the projector lens can be located substantially on the horizontal imaginary plane, and the second boundary line of the projector lens can be substantially parallel with the horizontal imaginary plane to form a light distribution pattern such that extends in the horizontal direction on a substantially horizontal line.

In addition, each of the angles between virtual lines connecting the center of the semiconductor light source to the first boundary line and other virtual lines connecting the center to the second boundary line in the direction perpendicular to the horizontal imaginary plane can be within a range from −0.6 degrees in a direction toward the first boundary line with reference to the horizontal imaginary plane to 5.0 degrees in a direction toward the second boundary line with reference to the horizontal imaginary plane to conform to a vehicular standard for a light distribution of an overhead sign area. The second light-emitting surface can be configured to form the polarization angle of the light-emitting surface in the direction perpendicular to the horizontal imaginary plane within 10 degrees to inhibit the color separation of the light distribution pattern. Moreover, the vehicle headlights further can include a base board for mounting the semiconductor light source, and a heat sink to radiate heat generated from the semiconductor light source and to also attach the projector lens.

According to another aspect of the disclosed subject matter, light having a high brightness, which is located close to the optical axis of the projector lens in light emitted from the semiconductor light source, can be projected underneath a horizontal line, and light that is located slightly away from the optical axis can be diffused in the downward direction so as to extend in the horizontal direction using the light rays emitted from the first and the third light-emitting surfaces of the projector lens. Additionally, the second light-emitting surface can receive the light emitted from the semiconductor light source from the light incoming surface at an incident angle of approximately zero degree, and therefore can illuminate on the overhead sign area while diffusing the light in the horizontal direction and while diffusing the light within the range from downward 0.6 degrees to upward 5 degrees in the vertical direction, in which chromatic aberration is very small by inhibiting the color separation as the light distribution pattern for the overhead sign area. Thus, an aspect of the disclosed subject matter can provide a small projector type headlight that can provide a favorable basic light distribution pattern used as a low beam and a favorable light distribution pattern for the overhead sign area, which can inhibit the color separation so as to be able to conform to a vehicular standard of the light distribution for the overhead sign area with confidence.

According to another aspect of the disclosed subject matter, the above-described exemplary vehicle headlights can further include at least one LED optical unit located adjacent the vehicle headlight, wherein the LED optical unit projects a light distribution pattern including an elbow line between two horizontal cut-off lines in a direction toward a light-emission of the vehicle headlight during operation.

In the above-described vehicle headlight including the LED optical unit, the vehicle headlight can provide a favorable light distribution pattern including the elbow line between the two horizontal cut-off lines for a driving lane and an oncoming lane in addition to the basic light distribution pattern and the light distribution pattern for the overhead sign area, by locating the LED optical unit adjacent the vehicle headlight. Thus, another aspect of the disclosed subject matter can provide vehicle headlights including at least one LED optical unit, which can form a favorable light distribution pattern including the elbow line between the two horizontal cut-off lines and the light distribution pattern for the overhead sign area such that can be used as a low beam for various vehicles including a small size car.

BRIEF DESCRIPTION OF THE DRAWINGS

These and other characteristics and features of the disclosed subject matter will become clear from the following description with reference to the accompanying drawings, wherein:

FIGS. 3*b* and 3*c* are cross-sectional views showing light paths on a cross-section taken along a vertical plane passing through an optical axis of the projector lens, wherein FIG. 3*c* is a close-up view showing the light path on the cross-section of a second light-emitting surface of the projector lens;

DETAILED DESCRIPTION OF EXEMPLARY EMBODIMENTS

Figure 1:
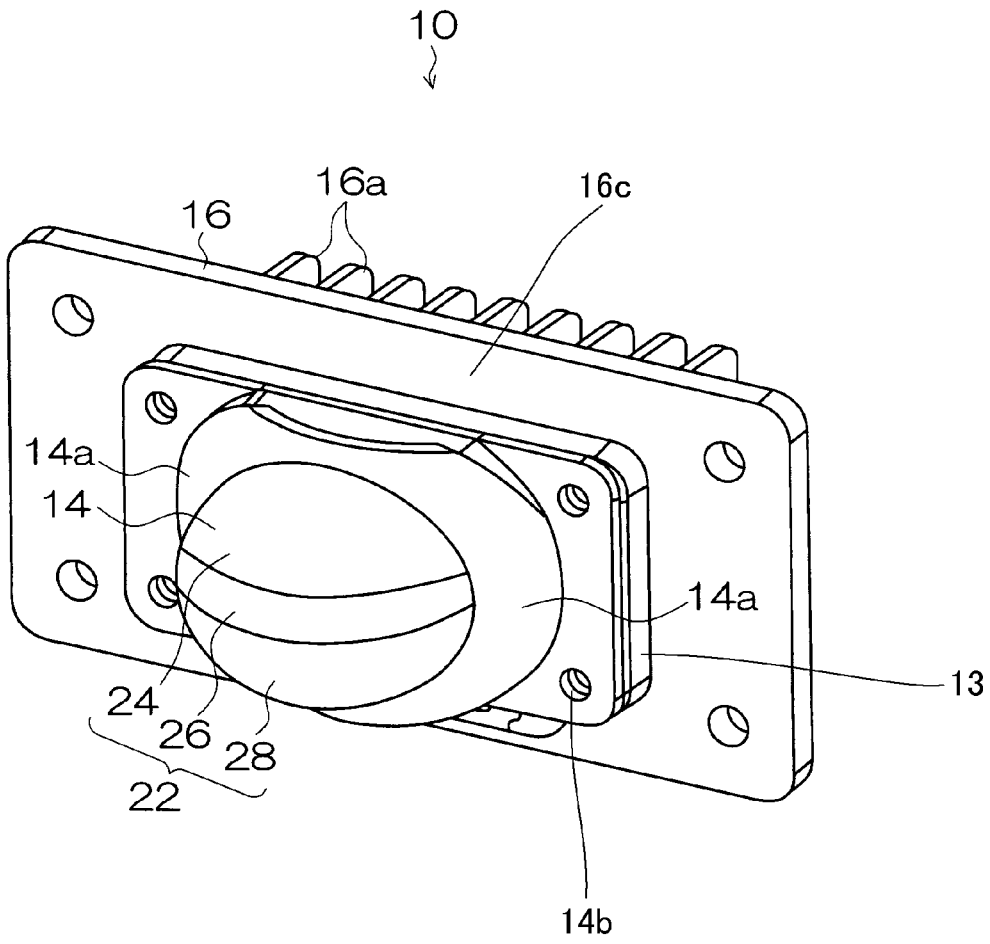
FIG. 1 is a perspective view showing an exemplary embodiment of a vehicle headlight made in accordance with principles of the disclosed subject matter.

The disclosed subject matter will now be described in detail with reference to FIG. 1 to FIG. 6*b*, in which the same or corresponding elements use the same reference marks. FIG. 1 is a perspective view showing an exemplary embodiment of a vehicle headlight made in accordance with principles of the disclosed subject matter. The vehicle headlight 10 can be attached to a front left of a vehicle. Another headlight that is symmetrical to the headlight 10 and is the substantially same as the headlight 10 can be attached to a front right of the vehicle.

Therefore, the vehicle headlight 10 will be described in detail, and the other headlight attached to the front right of the vehicle will be appropriately abbreviated. The headlight 10 can include: a heat sink 16 having a cooling fin 16*a* and a rear surface 16*c* formed in a substantially plane shape; a frame 13 attached to the rear surface 16*c* of the heat sink 16 so as to be located in an opposite direction of the cooling fin 16*a*; and a projector lens 14 having a light-emitting surface 22, a base portion 14*a* and a locating hole 14*b* being attached to the frame 13 using the locating hole 14*b* via screws and the like so that the base portion 14*a* faces the frame 13, the light-emitting surface 22 including a first light-emitting surface 24, a second light-emitting surface 26 and a third light-emitting surface 28, and each of the first light-emitting surface 24, the second light-emitting surface 26 and the third light-emitting surface 28 extending in a horizontal direction.

Figure 2:
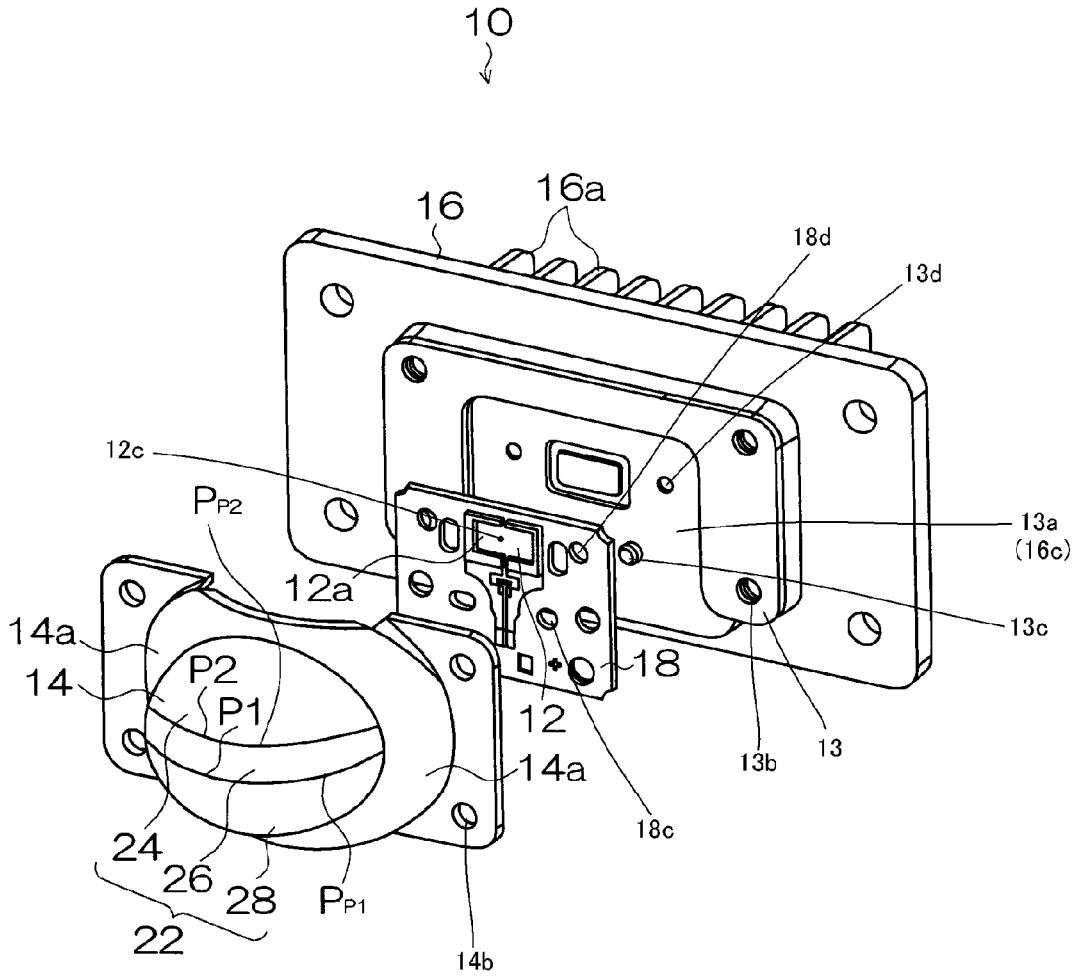
FIG. 2 is a perspective exploded view showing the vehicle headlight shown in FIG. 1.

FIG. 2 is a perspective exploded view showing the vehicle headlight 10. The headlight 10 can also include a base board 18 having a first locating hole 18*c* and a second locating hole 18*d*; a semiconductor light source 12 having an emitting surface 12*a* and a center 12 located on an optical axis of the semiconductor light source 12, and the semiconductor light source 12 emitting light having a substantially white color tone and being mounted on the base board 18, and the emitting surface formed in a substantially plane shape and intersecting with the optical axis at a substantially right angle; and a plate 13*a* having a locating pin 13*c* and a locating screw hole 13*d* located between the rear surface 16*c* of the heat sink 16 and the frame 13 having a locating screw hole 13*b*, and attaching the base board 18 using the first locating hole 18*c* and the second locating hole 18*d*, which correspond to the locating pin 13*c* and the locating screw hole 13*d* of the plate 13*c*, respectively, via screws, etc.

In this case, the rear surface 16*c* of the heat sink 16 can include the structure of the plate 13*a*, as shown by (16*c*) in FIG. 2. The projector lens 14 can also include an optical axis AX and at least one focus F located on the optical axis AX so that the optical axis AX of the projector lens 14 substantially corresponds to the optical axis of the semiconductor light source 12. However, although neither FIG. 1 nor FIG. 2 shows the optical axis AX and the focus F of the projector lens 12 and the optical axis of the semiconductor light source 12 (only the center 12*c* located on the optical axis of the semiconductor light source 12 is shown in FIG. 2) to facilitate visualization of the figures, the optical axis AX and the focus F of the projector lens 14 will be shown in FIG. 3 and FIG. 4 described later.

Here, each of the above-described elements will now be described in detail. As the semiconductor light source 12, semiconductor light-emitting devices emitting light having the substantially white color tone such that is disclosed in Patent document No. 2 can be used. The emitting surface 12*a* of the semiconductor light source 12 can be formed in a substantially rectangular shape so as to extend longer in a horizontal direction (direction of a width of vehicles).

Accordingly, if the projector lens 14 include a horizontal imaginary plane, which intersects with the optical axes AX of the projector lens 14 substantially corresponding to the optical axis of the semiconductor light source 12 and extends in the horizontal direction, when the emitting surface 12*a* of the semiconductor light source 12 is divided into two surfaces by the horizontal imaginary plane, each of the divided two surfaces of the emitting surface 12*a* can also be formed in a substantially rectangular shape. The semiconductor light source 12 can include a blue light-emitting chip(s) (LED chip) and a wavelength converting material including a phosphor to emit the light having the substantially white color tone.

In this case, the wavelength converting material can include a resin layer that is made by mixing a yellow phosphor such as YAG with a transparent resin such as a silicone resin and the like in order to emit a substantially white light by an additive color mixture of the excited yellow light emitted from the yellow phosphor and a part of the blue light emitted from the blue LED chip. In place of the yellow phosphor, a red phosphor (e.g., $CaAlSiN_3$: $Eu_{2+}$) wavelength-converting the blue light emitted from the blue LED chip into red-purple light, and a green phosphor (e.g., Y3(Ga, Al)$_5O_{12}$: $Ce^{3+}$) wavelength-converting the blue light into blue-green light can also be used to emit the substantially white light by an additive color mixture of the red-purple light emitted from the red phosphor that is excited by the blue light, the blue-green light emitted from the green phosphor that is excited by the blue light and a part of the blue light.

The semiconductor light source 12 can also include an LED chip of InGaN series that emits near-ultraviolet light having a wavelength of approximately 380 nanometers, a laser diode that emits ultraviolet light, and the like. In this case, in order to emit the substantially white light, the phosphor can include: a red phosphor (e.g., $Ca_2Si_5N_8$: $Eu^{2+}$) wavelength-converting the ultraviolet light into red light; a green phosphor (e.g., $(Si, Al)_6(O, N)$: $Eu^{2+}$) wavelength-converting the ultraviolet light into green light; and a blue phosphor (e.g., $(Sr, Ca, Ba, Mg)_{10}(PO_4)_6Cl_2$: $Eu^{2+}$) wavelength-converting the ultraviolet light into blue light.

The LED chip, the laser diode and the like can be aligned in a straight line (e.g., four pieces each having a light-emitting surface of one millimeter square), and can be encapsulated with the above-described wavelength converting material, and thereby can form the emitting surface 12*a* of the semiconductor light source 12 that is formed in the substantially rectangular shape. The emitting surface 12*a* of the semiconductor light source 12 can also be formed in the substantially rectangular shape by aligning four same white LEDs in a straight line.

The base board 18 mounting the semiconductor light source 12 can include an Aluminum nitride substrate, an aluminum plate, a copper plate having a high thermal conductivity and the like, and also can be composed of a printed circuit board having a thermal resistance using a similar structure, such that is disclosed in Patent document No. 3. When the printed circuit board is used as the base board 18, electrical connecting methods to provide the semiconductor light source 12 with a power supply may become easy, as disclosed in Patent document No. 3.

The plate 13*a* (16*c*) for attaching the base board 18 and the heat sink 16 for radiating heat generated from the semiconductor light source 12 via the plate 13*a* (16*c*) can include metallic materials such as aluminum, copper having a high thermal conductivity and the like. The frame 13 can attach the projector lens 14 while guarding the base board 18 mounting the semiconductor light source 12. When the frame 13, the plate 13*a* (16*c*) and the heat sink 16 are cast integrally as one body, they can be made by an extrusion molding method, a die casting method, which can manufacture them with high dimensional accuracy, etc. The frame 13 can also be made of resins having a thermal resistance such as polyester, phenol, polycarbonate, etc.

In addition, as disclosed in Patent document No. 4 by the inventor of this disclosed subject matter, by providing a heat pipe between the heat sink 16 and a predetermined position in a rear surface of the plate 13*a* without the locating pin 13*c* and the locating screw hole 13*d*, which is located adjacent the rear surface 16*c* of the heat sink 16, the heat sink 16 can be removed from the plate 13*a* and can be located in an arbitrary position such as a reversed side of the vehicle headlight 10, etc.

In this case, when the headlight 10 is viewed from the light-emitting surface 22 of the projector lens 14, an outline of the headlight 10 can correspond to an outline of the projector lens 14 while the heat sink 16 is separated from the frame 13. As a result, the headlight 10 can be miniaturized, and therefore can be designed so as to match an outside appearance of various vehicles. Moreover, when a light distribution pattern projected by the vehicle headlight 10 is adjusted in a horizontal direction and in a vertical direction with respect to the optical axis AX of the projector lens 14, adjusting structures disclosed in Patent document No. 4 can also be used regardless of a location of the heat sink 16.

The projector lens 14 can be attached to the frame 13 using the locating screw hole 13*b* of the frame 13 and the locating hole 14*b* of the projector lens 14 via screws, etc. The projector lens 14 further can include a first horizontal boundary line $P_{P1}$ located between the second light-emitting surface 26 and the third light-emitting surface 28 and a second horizontal boundary line $P_{P2}$ located between the first light-emitting surface 24 and the second light-emitting surface 26 so that the first horizontal boundary line $P_{P1}$ and the second horizontal boundary line become substantially parallel with respect to each other.

In this case, the optical axis AX of the projector lens 14 can intersect substantially with the center 12*c* of the emitting surface 12*a* of the light source 12 at a substantially right angle with respect to the emitting surface 12*a*, and also can intersect substantially with the first horizontal boundary lines $P_{P1}$. The focus F located on the optical axis AX of the projector lens 14 can be located substantially at the center 12*c* of the emitting surface 12*a* of the projector lens 14, as described with reference to FIG. 3*a* to FIG. 4 later.

The projector lens 14 can be made of a transparent resin such as the polycarbonate, an acrylic resin and the like, and also can be made of an inorganic material such as a glass, etc. The projector lens 14 can be casted by a mold injection method. In this case, the projector lens 14 can also be made of the transparent resin by an integral plastic molding method along with the frame 13. Accordingly, the semiconductor light source 12 mounted on the base board 18 can be easily maintained at the above-described appropriate position with respect to the projector lens 14 by attaching the projector lens 14 integrated with the frame 13 to either the rear surface 16*c* of the heat sink 16 or the plate 13*a*.

Therefore, the structure, in which the projector lens 14 is integrated with the frame 13, can also provide the vehicle headlight 10 that cannot only form a favorable light distribution pattern with accuracy and a simple structure but also can reduce size of the headlight with a good outside appearance. An exemplary light distribution pattern projected by the vehicle headlight 10 will now be described with reference to FIG. 3*a* to FIG. 4.

Figure 3A:
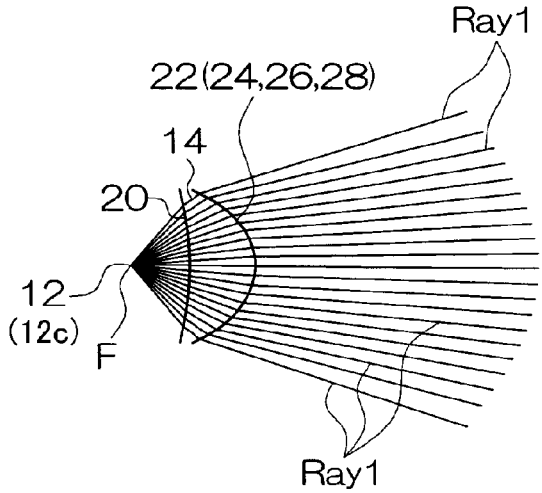
FIG. 3*a* is a cross-sectional top view showing light path on a cross-section taken along a horizontal plane passing through a first light-emitting surface of a projector lens made in accordance with principles of the disclosed subject matter.
Figure 3B:
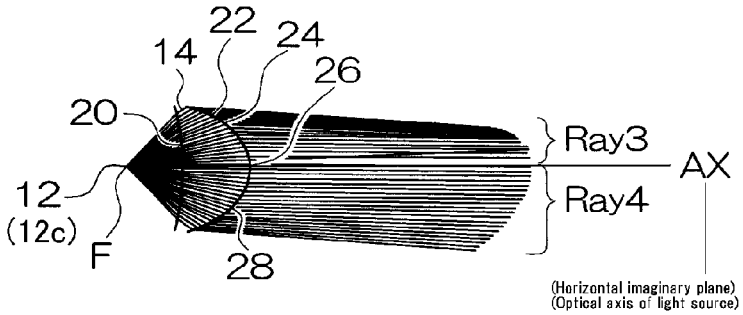
Figure 3C:
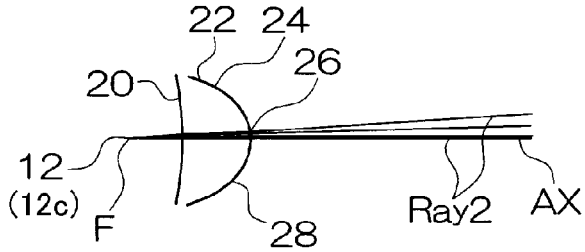

FIG. 3*a* is a cross-sectional top view showing light path on a cross-section taken along a horizontal plane passing through the first light-emitting surface 24 of the light-emitting surface 22 of the projector lens 14, and FIGS. 3*b* and 3*c* are cross-sectional views showing light paths on a cross-section taken along a vertical plane passing through the optical axis AX of the projector lens 14, wherein the semiconductor light source 12 shows only the center 12*c* located on the emitting surface 12*a* and also located on the optical axis of the semiconductor light source 12, because the semiconductor light source 12 is very small as compared with the projector lens 14.

A light incoming surface 20 of the projector lens 14 can be formed in at least one of a concave shape and a plane shape, and the light-emitting surface 22 can be formed in a convex shape. Thereby, the substantially white light emitted from the semiconductor light source 12 can enter into the projector lens 14 from the light incoming surface 20 and can be projected in a direction toward a light-emission of the headlight 10 from the light-emitting surface 22 of the projector lens 24 while enlarging the substantially white light going ahead.

Ray1 shown in FIG. 3*a* include rays emitted from the first, the second and the third light-emitting surfaces 24, 26 and 28 of the light-emitting surface 22 of the projector lens 14 due to the top view from the horizontal cross-section of the first light-emitting surface 24. The projector lens 14 can be configured to diffuse Ray1 emitted from the first, the second and the third light-emitting surfaces 24, 26 and 28 in the horizontal direction toward the light-emission of the vehicle headlight 10.

The first light-emitting surface 24 can be configured to direct Ray3 emitted from the first light-emitting surface 24 in a downward direction with reference to a prescribed angle (e.g., 0.6 degrees) with respect to the horizontal imaginary plane, which intersects with the optical axis AX of the projector lens 14, as shown in FIG. 3*b*. Specifically, the first light-emitting surface 24 can be configured to gradually increase a polarization angle in a vertical direction thereof with increasing distance from the optical axis AX of the projector lens 14.

Thereby, light having a high brightness, which is close to the optical axis AX in light emitted from the light source 23, can be projected underneath a horizontal cut-off line, and light that is slightly away from the optical axis AX can be diffused in the downward direction and in the horizontal direction toward the light-emission of the vehicle headlight 10. Accordingly, Ray1 and Ray3 emitted from the first light-emitting surface 24 of the projector lens 14 can form a basic light distribution pattern having a high faraway visibility, which can be used as a low beam for a headlight.

The third light-emitting surface 28 can also be configured to diffuse Ray1 emitted from the third light-emitting surfaces 28 in the horizontal direction toward the light-emission of the vehicle headlight 10, as shown in FIG. 3*a*. In addition, the third light-emitting surface 28 of the light-emitting surface 22 can also be configured to direct Ray4 emitted from the third light-emitting surface 28 in the downward direction with reference to a prescribed angle (e.g., 0.6 degrees), which is located in the downward direction with respect to the horizontal imaginary plane intersecting with the optical axis AX of the projector lens 14, in common with Ray3 as shown in FIG. 3*b*.

More specifically, the third light-emitting surface 28 can be configured to gradually increase a polarization angle in a vertical direction thereof with increasing distance from the optical axis AX of the projector lens 14. Therefore, light having a high brightness, which is close to the optical axis AX in the lights emitted from the light source 23, can be projected underneath the horizontal cut-off line, and light that is slightly away from the optical axis AX can be diffused in the downward direction and in the horizontal direction toward the light-emission of the vehicle headlight 10. Thereby, Ray1 and Ray4 emitted from the third light-emitting surface 28 of the projector lens 14 can form the basic light distribution pattern having a high faraway visibility, which can be used as a low beam for a headlight along with the first light-emitting surface 22 of the projector lens 14 using the lights emitted from the semiconductor light source 12.

The second light-emitting surface 26 can also be configured to diffuse Ray1 emitted from the second light-emitting surfaces 26 in the horizontal direction toward the light-emission of the vehicle headlight 10, as shown in FIG. 3*a*. In this case, the second light-emitting surface 26 can be configured to direct Ray2 emitted from the second light-emitting surface 26 in an upward direction with reference to the prescribed angle (e.g., 0.6 degrees), which is located in the downward direction with respect to the horizontal imaginary plane intersecting with the optical axis AX of the projector lens 14, for exemplary, within a range from −0.6 degrees (downward 0.6 degrees) to upward 5 degrees with reference to the horizontal imaginary plane.

The overhead sign area is generally a region which ranges upward 2 to 4 degrees with respect to a horizontal line and either 4 degrees or 8 degrees in both horizontal directions with respect to a vertical line on a vertical imaginary screen that is approximately 25 meters away from a vehicle under a vehicular standard, and also where transportation guide signs, road traffic signs and the like are typically located. An exemplary embodiment of the disclosed subject matter emits Ray2 using the second light-emitting surface 26 within a range from zero degrees to upward 5 degrees with reference to the horizontal imaginary plane to illuminate the overhead sign area on the safe side, as shown in FIG. 3*c*.

Figure 4:
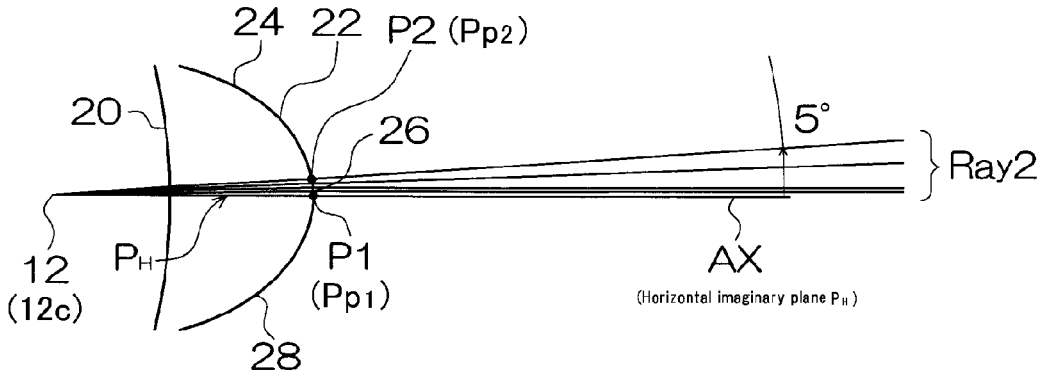
FIG. 4 is an enlarged cross-sectional view showing the light path on the cross-section of the second light-emitting surface of the projector lens of FIG. 3*c;*

FIG. 4 is an enlarged cross-sectional view showing the light path on the cross-section of the second light-emitting surface 26 of the projector lens 14 of FIG. 3*c*. The second light-emitting surface 26 can be located between the first light-emitting surface 22 and the third light-emitting surface 28 so as to zone in a substantially parallel fashion on the light-emitting surface 22. Thereby, a light distribution pattern for the overhead sign area can be formed in a band shape, that extends in the horizontal direction and in a substantially parallel fashion.

The second light-emitting surface 26 can be configured to reduce a polarization angle thereof at 10 degrees or less to inhibit a color separation of light emitted from the second light-emitting surface 26. In one embodiment of the disclosed subject matter, the second light-emitting surface 26 can be located between a first point P1 located on the first horizontal boundary line $P_{P1}$ (shown in FIG. 2) and a second point P2 the second horizontal boundary line $P_{P2}$ (shown in FIG. 2). In this case, the first horizontal boundary line $P_{P1}$ (shown in FIG. 2) including the first point P1 can be located substantially on the horizontal imaginary plane $P_H$ intersecting with the optical axis AX of the projector lens 14, and each of angles of virtual lines connecting the center 12*c* of the semiconductor light source 12 to the second horizontal boundary line $P_{P2}$ (shown in FIG. 2) including the second point P2 with respect to the horizontal imaginary plane $P_H$ can be approximately five degrees in a direction perpendicular to the horizontal imaginary plane $P_H$.

Accordingly, Ray2 emitted from the second light-emitting surface 26 of the light-emitting surface 22 can intersect with Ray3 emitted from the first light-emitting surface 24, and can form the light distribution pattern for the overhead sign area. In this case, the second light-emitting surface 26 can receive light emitted from the semiconductor light source 12 from the light incoming surface 20, where is substantially or approximately perpendicular to the light emitted from the semiconductor light source 12, and therefore can receive the light at an incident angle of approximately zero degree.

The second light-emitting surface 26 of the projector lens 24 can illuminate on the overhead sign area using Ray1 and Ray2, in which chromatic aberration is very small by inhibiting the color separation. Thus, the disclosed subject matter can provide a favorable light distribution pattern for the overhead sign area, which can inhibit the color separation and can provide a high level of visibility to drivers and pedestrians, and which can conform to a vehicular standard for the light distribution of the overhead sign area with confidence.

Figure 5:
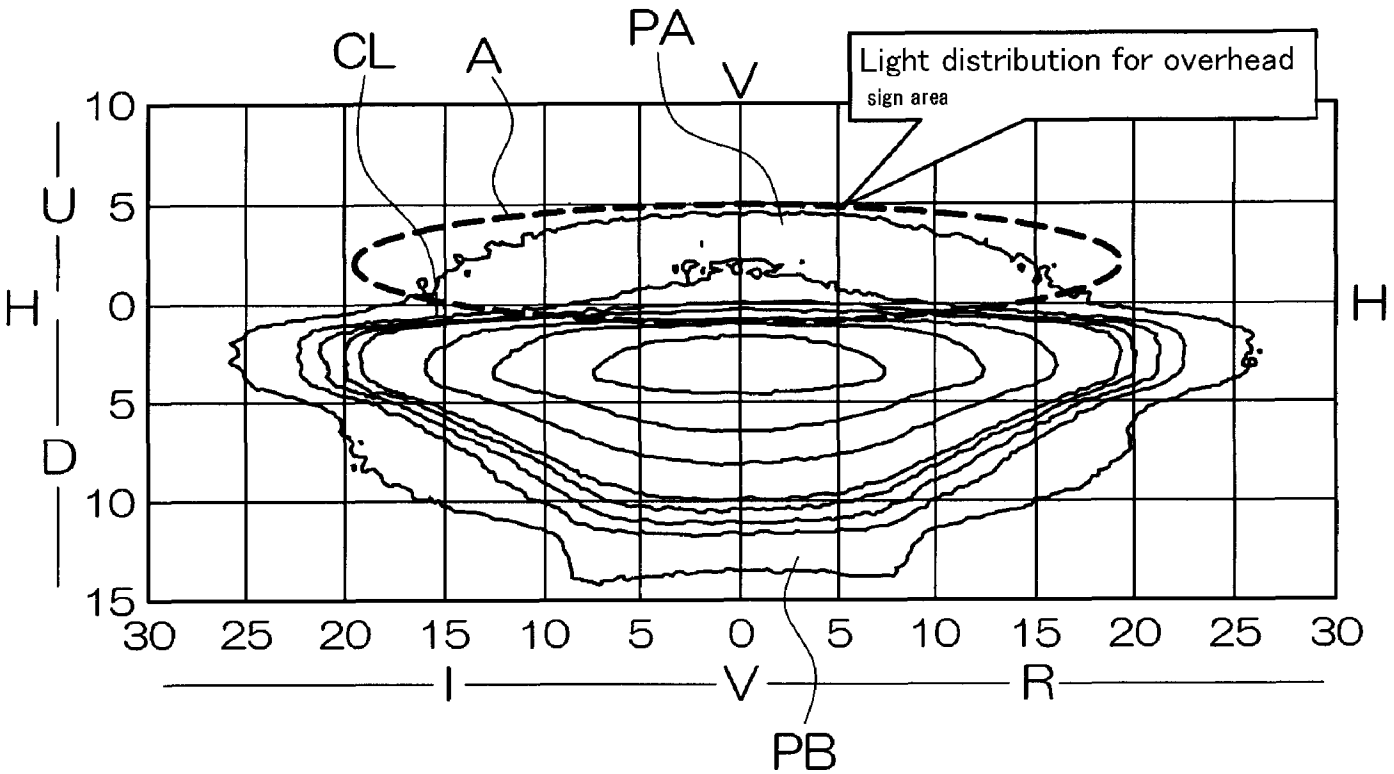
FIG. 5 is an exemplary light distribution pattern projected by the vehicle headlight of FIG. 1.

FIG. 5 is an exemplary light distribution pattern on the vertical imaginary screen that is approximately 25 meters away from a vehicle, which is formed by the vehicle headlight 10, wherein H-H and V-V show a horizontal line and a vertical line, respectively, "I" and "R" show a leftward and rightward direction with respect to the vertical line V-V, respectively, and "U" and "D" show an upward and downward direction with respect to the horizontal line H-H, respectively.

Accordingly to the vehicle headlight 10, the second light-emitting surface 26 can receive the light emitted from the semiconductor light source 12 from the light incoming surface 20 at the incident angle of approximately zero degree, and can illuminate on the overhead sign area A while diffusing in the horizontal direction of the headlight 10 using Ray1 (shown in FIG. 3*a*) and while diffusing within the range from downward 0.6 degrees to upward 5 degrees in the vertical direction using Ray2, in which chromatic aberration is very small by inhibiting the color separation as a light distribution pattern PA for the overhead sign area A.

The first light-emitting surface 24 and the third light-emitting surface 28 can receive the light emitted from the semiconductor light source 12 from the light incoming surface 20 at an incident angle of relatively large degree as compared with the light incoming surface 20 for the second light-emitting surface 26, and can diffuse Ray1 (shown in FIG. 3*a*) in the horizontal direction toward the light-emission of the vehicle headlight 10. In addition, the first light-emitting surface 24 and the third light-emitting surface 28 can diffuse Ray3 and Ray4 in the downward direction with reference to the prescribed angle (e.g., 0.6 degrees), respectively, because each of the first and the third light-emitting surface 24 and 28 can be configured to gradually increase the polarization angle in the vertical direction thereof with increasing distance from the optical axis AX of the projector lens 14.

Therefore, the light having a high brightness, which is close to the optical axis AX in the light rays emitted from the light source 23, can be projected underneath the horizontal cut-off line CL, and the light that is slightly away from the optical axis AX can be diffused in the downward direction and in the horizontal direction toward the light-emission of the vehicle headlight 10. Ray1, Ray3 and Ray4 emitted from the first and the third light-emitting surface 24 and 28 of the projector lens 14 can form the basic light distribution pattern PB having a high faraway visibility, which can be used as a low beam for a headlight.

Figure 6A:
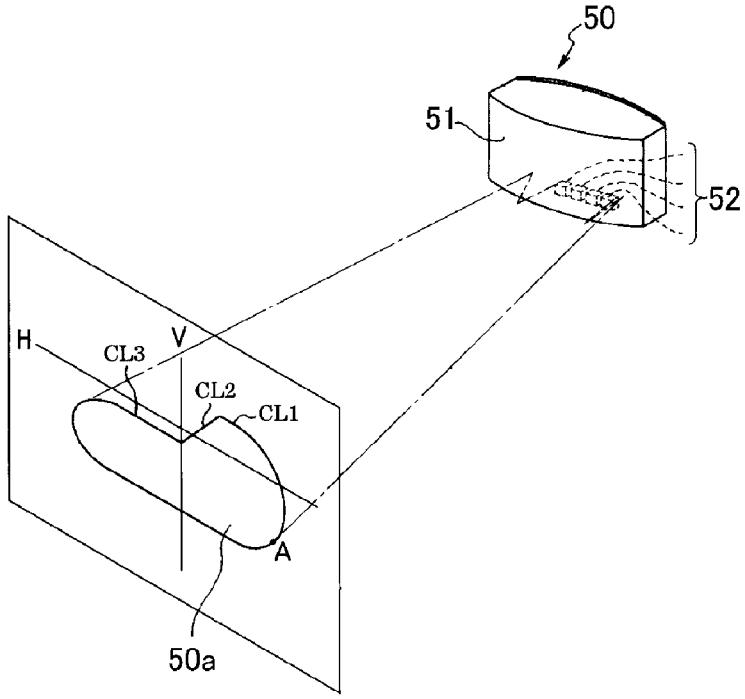
FIG. 6a Conventional Art
FIG. 6*a* is a light distribution pattern projected by an LED optical unit disclosed in Patent documents No. 5 and No. 6.

FIG. 6*a* is a light distribution pattern on the vertical imaginary screen that is approximately 25 meters away from a vehicle, which is projected by an LED optical unit disclosed in Patent documents No. 5 and No. 6, in which one of the inventors is the inventor of the presently disclosed subject matter. The LED optical unit 50 including a light source 52, which is formed in a very small size, can provide a light distribution pattern 50*a*, which includes an elbow line CL2 between horizontal cut-off lines CL1 and CL3 for a driving lane and an oncoming lane.

Figure 6B:
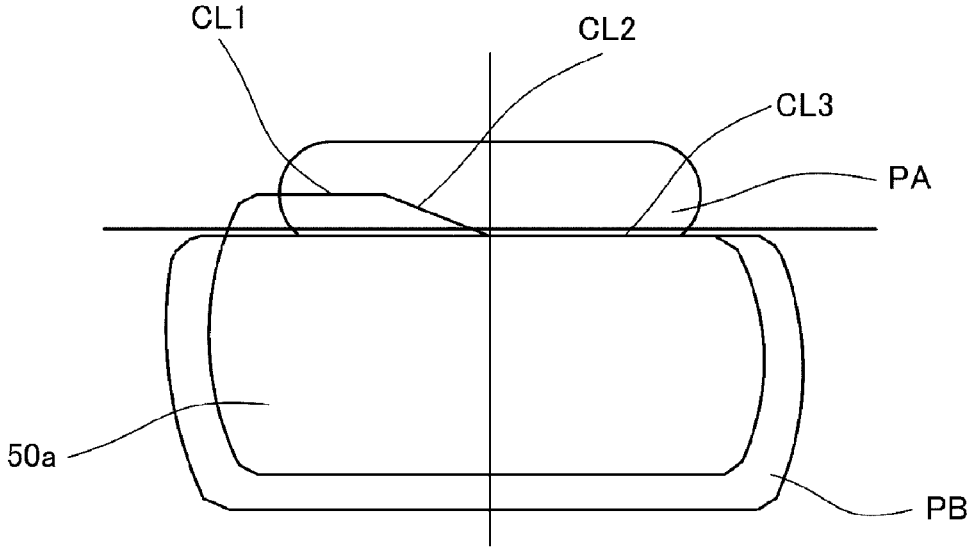
FIG. 6*b* is an exemplary light distribution pattern combining the light distribution pattern of FIG. 6*a* with the light distribution pattern of FIG. 5.
Figure 7A:
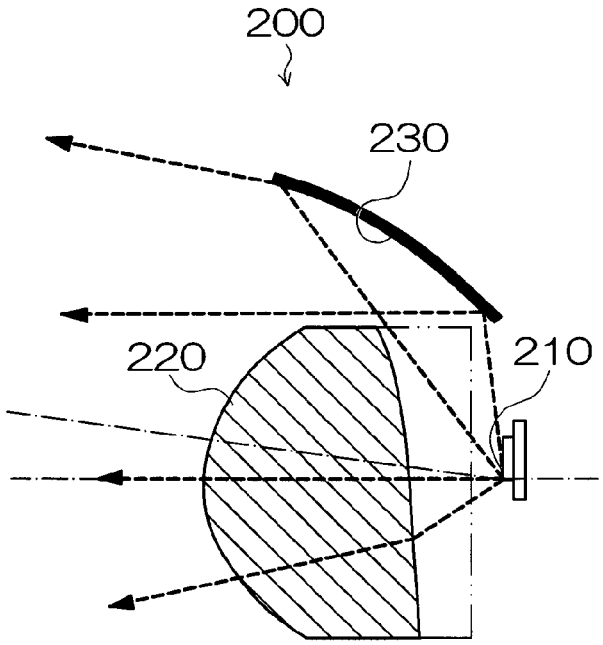
FIG. 7a Conventional Art
FIG. 7*a* is a cross-sectional view showing a conventional vehicle lamp capable of forming a light distribution pattern toward an overhead sign area.
Figure 7B:
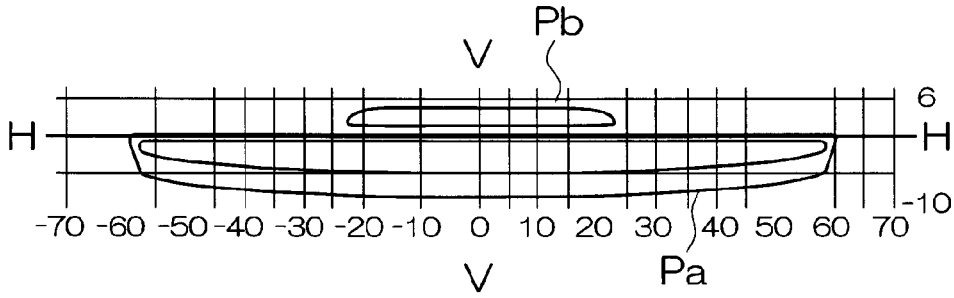
FIG. 7b Conventional Art
FIG. 7*b* is an exemplary light distribution pattern formed by the vehicle lamp of FIG. 7*a.*

FIG. 6*b* is an exemplary light distribution pattern combining the light distribution pattern of FIG. 6*a* with the light distribution pattern of FIG. 5. The light distribution pattern shown in FIG. 5 can include the horizontal cut-off line CL, however, does not include an elbow line. Therefore, the disclosed subject matter can also provide a light distribution pattern including the elbow line CL2 between the horizontal cut-off lines CL1 and CL3 in addition to the basic light distribution pattern PB and the light distribution pattern PA for the overhead sign area, by locating at least one of the LED optical units 50 disclosed in Patent documents No. 5 and No. 6 adjacent the vehicle headlight 10.

Therefore, the disclosed subject matter can provide vehicle headlights including at least one the LED optical unit, which can form a favorable light distribution pattern including the elbow line between the two horizontal cut-off lines CL1 and CL3 for a driving lane and an oncoming lane and the favorable light distribution pattern for the overhead sign area such that can be used as a low beam for various vehicles including a small size car.

According to the disclosed subject matter, the vehicle headlight 10 can project light having a high brightness, which is located close to the optical axis AX of the projector lens 14 in lights emitted from the semiconductor light source 12, underneath the horizontal cut-off line CL, and also can project light that is located slightly away from the optical axis in the downward direction so as to extend in the horizontal direction using the lights emitted from the first and the third light-emitting surfaces 24 and 28 of the projector lens 14. In addition, the vehicle headlight 10 can receive the light emitted from the semiconductor light source 12 from the light incoming surface 20 of the second light-emitting surface 26 at an incident angle of approximately zero degree, and can illuminate the light toward the overhead sign area while diffusing the light in the horizontal direction and while diffusing the light within the range from downward 0.6 degrees to upward 5 degrees in the vertical direction, wherein chromatic aberration can become very small by inhibiting the color separation as the light distribution pattern for the overhead sign area.

Thus, the disclosed subject matter can provide a small projector type headlight without an additional reflector, which can provide a favorable basic light distribution pattern used as a low beam and a favorable light distribution pattern for the overhead sign area, which can inhibit the color separation so as to be able to conform to a vehicle standard of the light distribution for the overhead sign area with confidence.

Various modifications of the above disclosed embodiments can be made without departing from the spirit and scope of the presently disclosed subject matter. For example, a headlight can include a semiconductor light source directly mounted on a heat sink using the above-described structure so as to form a light distribution with the semiconductor light source 12 via the projector lens 14, and total heat generated from the semiconductor light source 12 can be separately radiated by using a heat pipe while the heat generated from the semiconductor light source 12 is minimized.

While there has been described what are at present considered to be exemplary embodiments of the invention, it will be understood that various modifications may be made thereto, and it is intended that the appended claims cover such modifications as fall within the true spirit and scope of the invention. All conventional art references described above are herein incorporated in their entirety by reference.

What is claimed is:

1. A vehicle headlight, comprising:

a semiconductor light source having an emitting surface, a center, and an optical axis, the light source configured to emit light having a substantially white color tone, the emitting surface formed in a substantially plane shape, intersecting with the optical axis at a substantially right angle and also intersecting with the optical axis at the center located on the emitting surface of the semiconductor light source; and a projector lens having an optical axis, at least one focus, a light incoming surface, a light-emitting surface and a horizontal imaginary plane being located adjacent the semiconductor light source so that the optical axis of the projector lens substantially corresponds to the optical axis of the semiconductor light source, the light incoming surface formed in at least one of a plane shape and a concave shape and facing the emitting surface of the semiconductor light source, the light-emitting surface having a polarization angle formed in a convex shape and including a first light-emitting surface, a second light-emitting surface, a third light-emitting surface, a first boundary line located between the second light-emitting surface and the third light-emitting surface and being located in an upward direction from zero degrees with reference to the horizontal imaginary plane, a second boundary line located between the first light-emitting surface and the second light-emitting surface, the horizontal imaginary plane intersecting with the optical axis of the projector lens, the light incoming surface configured to receive light having substantially white color tone from the semiconductor light source during operation, and wherein each of the first light-emitting surface and the third light-emitting surface is configured to diffuse the light in a horizontal direction and in a downward direction with reference to the horizontal imaginary plane, and the second light-emitting surface is configured to diffuse the light without intersections in the horizontal direction, wherein light emitted from the second light-emitting surface is configured to intersect with light emitted from the first light-emitting surface in a direction perpendicular to the horizontal imaginary plane.

2. The vehicle headlight according to claim 1, wherein each of the first light-emitting surface and the third light-emitting surface is configured to gradually increase the polarization angle of the light-emitting surface in the direction perpendicular to the horizontal imaginary plane with increasing distance from the optical axis of the projector lens.

3. The vehicle headlight according to claim 1, wherein the first boundary line of the projector lens is located substantially on the horizontal imaginary plane, and the second boundary line of the projector lens is substantially parallel with the horizontal imaginary plane.

4. The vehicle headlight according to claim 2, wherein the first boundary line of the projector lens is located substantially on the horizontal imaginary plane, and the second boundary line of the projector lens is substantially parallel with the horizontal imaginary plane.

5. The vehicle headlight according to claim 1, wherein each of two surfaces is formed in a substantially rectangular shape when the emitting surface of the semiconductor light source is divided into the two surfaces by the horizontal imaginary plane.

6. The vehicle headlight according to claim 2, wherein each of two surfaces is formed in a substantially rectangular shape when the emitting surface of the semiconductor light source is divided into the two surfaces by the horizontal imaginary plane.

7. The vehicle headlight according to claim 1, wherein each of angles between virtual lines connecting the center of the semiconductor light source to the first boundary line of the light-emitting surface of the projector lens and other virtual lines connecting the center of the semiconductor light source to the second boundary line of the light-emitting surface of the projector lens in the direction perpendicular to the horizontal imaginary plane is within a range from −0.6 degrees in a direction toward the first boundary line with reference to the horizontal imaginary plane to 5.0 degrees in a direction toward the second boundary line with reference to the horizontal imaginary plane.

8. The vehicle headlight according to claim 2, wherein each of angles between virtual lines connecting the center of the semiconductor light source to the first boundary line of the light-emitting surface of the projector lens and other virtual lines connecting the center of the semiconductor light source to the second boundary line of the light-emitting surface of the projector lens in the direction perpendicular to the horizontal imaginary plane is within a range from −0.6 degrees in a direction toward the first boundary line with reference to the horizontal imaginary plane to 5.0 degrees in a direction toward the second boundary line with reference to the horizontal imaginary plane.

9. The vehicle headlight according to claim 1, wherein the second light-emitting surface of the projector lens is configured to form the polarization angle of the light-emitting surface in the direction perpendicular to the horizontal imaginary plane within 10 degrees.

10. The vehicle headlight according to claim 2, wherein the second light-emitting surface of the projector lens is configured to form the polarization angle of the light-emitting surface in the direction perpendicular to the horizontal imaginary plane within 10 degrees.

11. The vehicle headlight according to claim 1, further comprising:

at least one light-emitting device (LED) optical unit located adjacent the vehicle headlight, wherein the LED optical unit is configured to project a light distribution pattern including an elbow line between two horizontal cut-off lines in a direction toward a light-emission of the vehicle headlight during operation.

12. A vehicle headlight, comprising:

a heat sink having a plate;

a base board attached to the plate of the heat sink;

a semiconductor light source having an emitting surface, a center and an optical axis being located adjacent the base board, and configured to emit light having a substantially white color tone, the emitting surface formed in a substantially plane shape, intersecting with the optical axis at a substantially right angle and also intersecting with the optical axis at the center located on the emitting surface of the semiconductor light source; and a projector lens having an optical axis, at least one focus, a light incoming surface, a light-emitting surface and a horizontal imaginary plane being attached to the heat sink along with the base board, the optical axis of the projector lens corresponding substantially to the optical axis of the semiconductor light source, the light incoming surface formed in at least one of a plane shape and a concave shape and facing the emitting surface of the semiconductor light source, the light-emitting surface having a polarization angle formed in a convex shape and including a first light-emitting surface, a second light-emitting surface, a third light-emitting surface, a first boundary line located between the second light-emitting surface and the third light-emitting surface and being located in an upward direction from zero degrees with reference to the horizontal imaginary plane, a second boundary line located between the first light-emitting surface and the second light-emitting surface, the optical axes of the projector lens and the second boundary line of the light-emitting surface being located on the horizontal imaginary plane, the light incoming surface configured to receive light having substantially white color tone from the semiconductor light source during operation, and wherein each of the first light-emitting surface and the third light-emitting surface of the projector lens is configured to gradually increase the polarization angle of the light-emitting surface in a direction perpendicular to the horizontal imaginary plane with increasing distance from the optical axis of the projector lens, and the second light-emitting surface is configured to diffuse the light without intersections in the horizontal direction, wherein light emitted from the second light-emitting surface is configured to intersect with the light emitted from the first light-emitting surface in a direction perpendicular to the horizontal imaginary plane.

13. The vehicle headlight according to claim 12, wherein the second boundary line of the light-emitting surface is substantially parallel with the first boundary line of the light-emitting surface of the projector lens.

14. The vehicle headlight according to claim 12, wherein each of two surfaces is formed in a substantially rectangular shape when the emitting surface of the semiconductor light source is divided into the two surfaces by the horizontal imaginary plane.

15. The vehicle headlight according to claim 13, wherein each of two surfaces is formed in a substantially rectangular shape when the emitting surface of the semiconductor light source is divided into the two surfaces by the horizontal imaginary plane.

16. The vehicle headlight according to claim 12, wherein each of angles between virtual lines connecting the center of the semiconductor light source to the first boundary line of the light-emitting surface of the projector lens with respect to the horizontal imaginary plane in the direction perpendicular to the horizontal imaginary plane is within 6.0 degrees.

17. The vehicle headlight according to claim 13, wherein each of angles between virtual lines connecting the center of the semiconductor light source to the first boundary line of the light-emitting surface of the projector lens with respect to the horizontal imaginary plane in the direction perpendicular to the horizontal imaginary plane is within 5.0 degrees.

18. The vehicle headlight according to claim 12, wherein the second light-emitting surface of the projector lens is configured to form the polarization angle of the light-emitting surface in the direction perpendicular to the horizontal imaginary plane within 10 degrees.

19. The vehicle headlight according to claim 13, wherein the second light-emitting surface of the projector lens is configured to form the polarization angle of the light-emitting surface in the direction perpendicular to the horizontal imaginary plane within 10 degrees.

20. The vehicle headlight according to claim 12, further comprising:

at least one LED optical unit located adjacent the vehicle headlight, wherein the LED optical unit is configured to project a light distribution pattern including an elbow line between two horizontal cut-off lines in a direction toward a light-emission of the vehicle headlight during operation.

* * * * *